US007388514B1

(12) United States Patent
McDow

(10) Patent No.: US 7,388,514 B1
(45) Date of Patent: Jun. 17, 2008

(54) EMERGENCY LIGHT ASSEMBLY

(76) Inventor: Steven E. McDow, 76 Robert St., Bridgeport, CT (US) 06606

( * ) Notice: Subject to any disclaimer, the term of this patent is extended or adjusted under 35 U.S.C. 154(b) by 229 days.

(21) Appl. No.: 11/186,376

(22) Filed: Jul. 22, 2005

(51) Int. Cl.
*G08G 1/095* (2006.01)

(52) U.S. Cl. ..... 340/907; 340/908; 340/815.45; 340/331; 340/332; 340/473; 40/541; 40/550; 40/557

(58) Field of Classification Search ..... 340/907, 340/908, 815.45, 331, 332, 473; 40/541, 40/550, 557
See application file for complete search history.

(56) References Cited

U.S. PATENT DOCUMENTS 4,899,416 A * 2/1990 Francis ..... 15/104.93
5,606,309 A 2/1997 Smith
D390,675 S 2/1998 Wilson
6,155,522 A * 12/2000 Anderson ..... 248/99
6,275,149 B1 8/2001 Tung
6,762,689 B2 * 7/2004 Dechape ..... 340/815.45
2003/0095052 A1 5/2003 Dechape
2003/0169164 A1 9/2003 Lau
2003/0222791 A1 12/2003 Smalls
2004/0046678 A1 3/2004 Grady, Jr.
2006/0162643 A1 * 7/2006 Aasgaard ..... 116/28 R

* cited by examiner

*Primary Examiner*—Tai Nguyen

(57) ABSTRACT

An emergency light assembly includes a flexible panel that has a first lateral edge and a second lateral edge. A first set of light emitters is mounted in the panel. The first set of light emitters is arranged in an arrow shape directed toward the first lateral edge. A second set of light emitters is mounted in the panel. The second set of light emitters is arranged in an arrow shape directed toward the second lateral edge. A control is operationally coupled to the first and second light emitters for selectively turning the first and second light emitters on or off. The control has an off setting turning each of the first and second sets of light emitters off, a first setting turning the first set of light emitters on, and a second setting turning the second set of light emitters on.

9 Claims, 4 Drawing Sheets

EMERGENCY LIGHT ASSEMBLY

BACKGROUND OF THE INVENTION

1. Field of the Invention

The present invention relates to emergency light devices and more particularly pertains to a new emergency light device for warning oncoming traffic of a stranded vehicle and that the traffic should move in a specific direction to avoid the vehicle.

2. Description of the Prior Art

The use of emergency light devices is known in the prior art. U.S. Patent Appl. No. 2004/0046678 shows a triangular shaped warning beacon containing light emitting diodes for warning oncoming traffic of an upcoming hazard. Another type of emergency light device is U.S. Patent Appl. No. 2003/0222791 which again includes a triangular shaped device having light emitters thereon and which also includes a plurality of suction cups for attaching the device to the top of a vehicle roof or trunk hood. Still yet another such device is found in U.S. Pat. No. 6,275,149 and again includes a triangular shaped warning sign which includes a plurality of light emitters for warning oncoming traffic of a hazard.

While these devices fulfill their respective, particular objectives and requirements, the need remains for a device that includes directional arrows directing on coming traffic to move to the left, right or outwardly from a middle section of a portion of road.

SUMMARY OF THE INVENTION

The present invention meets the needs presented above by generally comprising a flexible panel that has a front side, a back side, a top edge, a bottom edge, a first lateral edge, and a second lateral edge. A first set of light emitters is mounted in the panel and is configured to emit light outwardly from the front side. The first set of light emitters is arranged in an arrow shape directed toward the first lateral edge. A second set of light emitters is mounted in the panel and is configured to emit light outwardly from the front side. The second set of light emitters is arranged in an arrow shape directed toward the second lateral edge. A power supply is electrically coupled to each of the first and second set of light emitters. A control is operationally coupled to the first and second light emitters for selectively turning the first and second light emitters on or off. The control has an off setting turning each of the first and second sets of light emitters off, a first setting turning the first set of light emitters on, and a second setting turning the second set of light emitters on.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
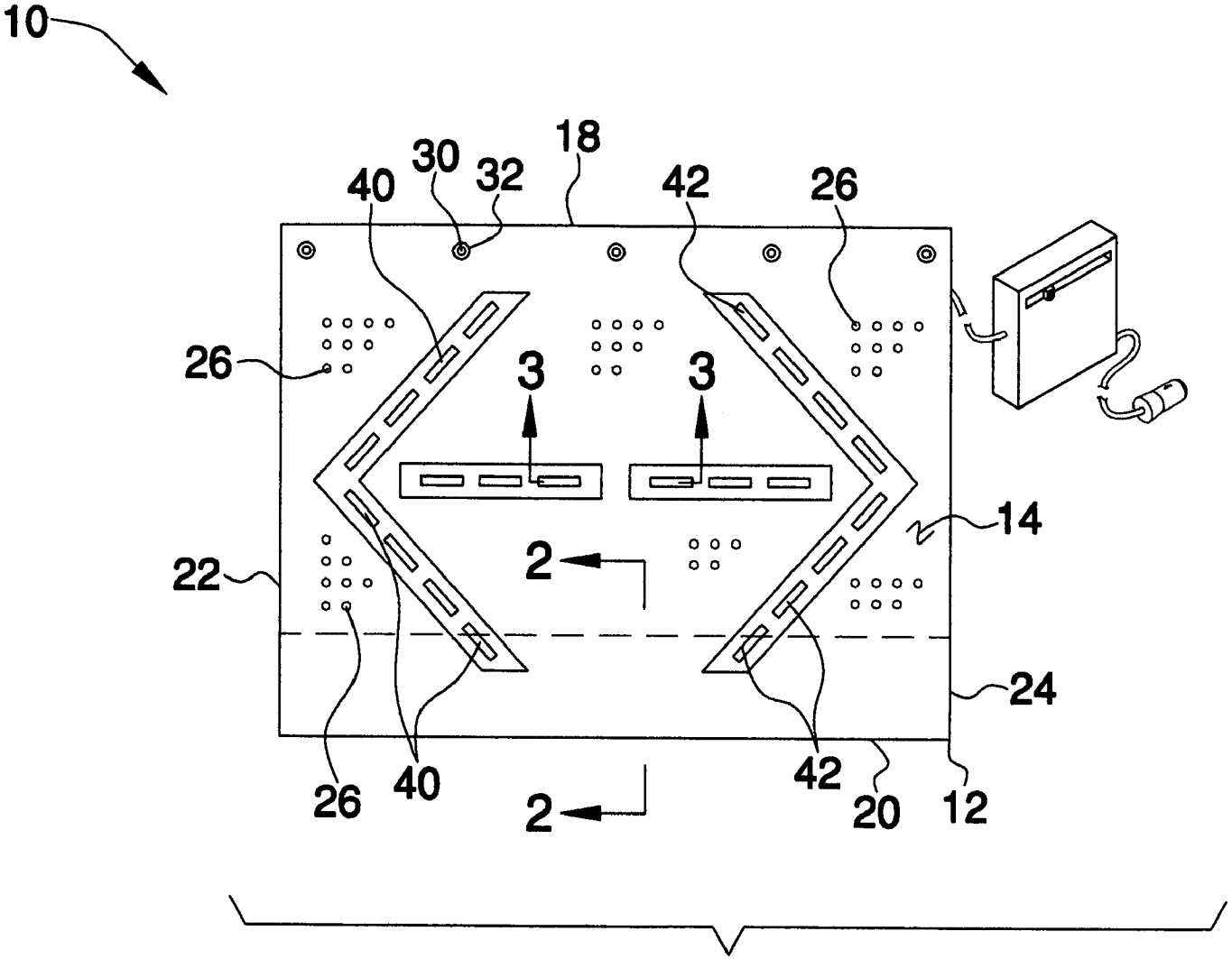
FIG. 1 is a front view of a emergency light assembly according to the present invention.
Figure 2:
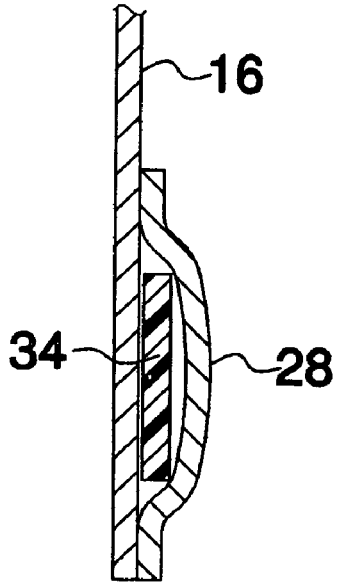
FIG. 2 is a cross-sectional view taken along line 2-2 of FIG. 1 of the present invention.
Figure 3:
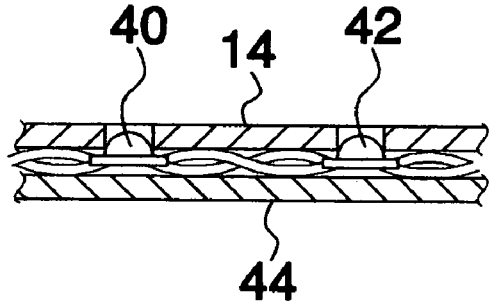
FIG. 3 is a cross-sectional view taken along line 3-3 of FIG. 1 of the present invention.
Figure 4:
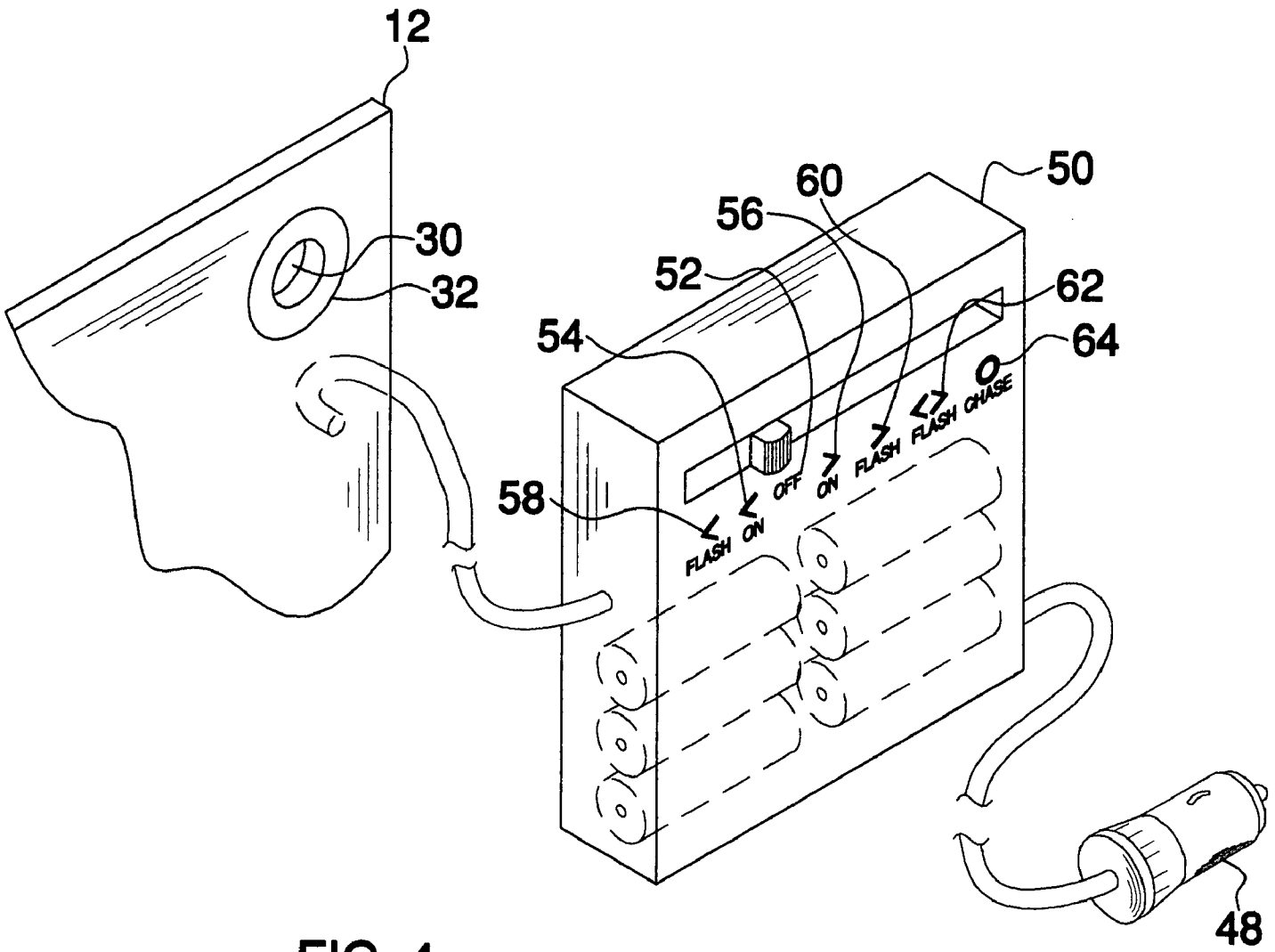
FIG. 4 is a perspective view of a control of the present invention.
Figure 5:
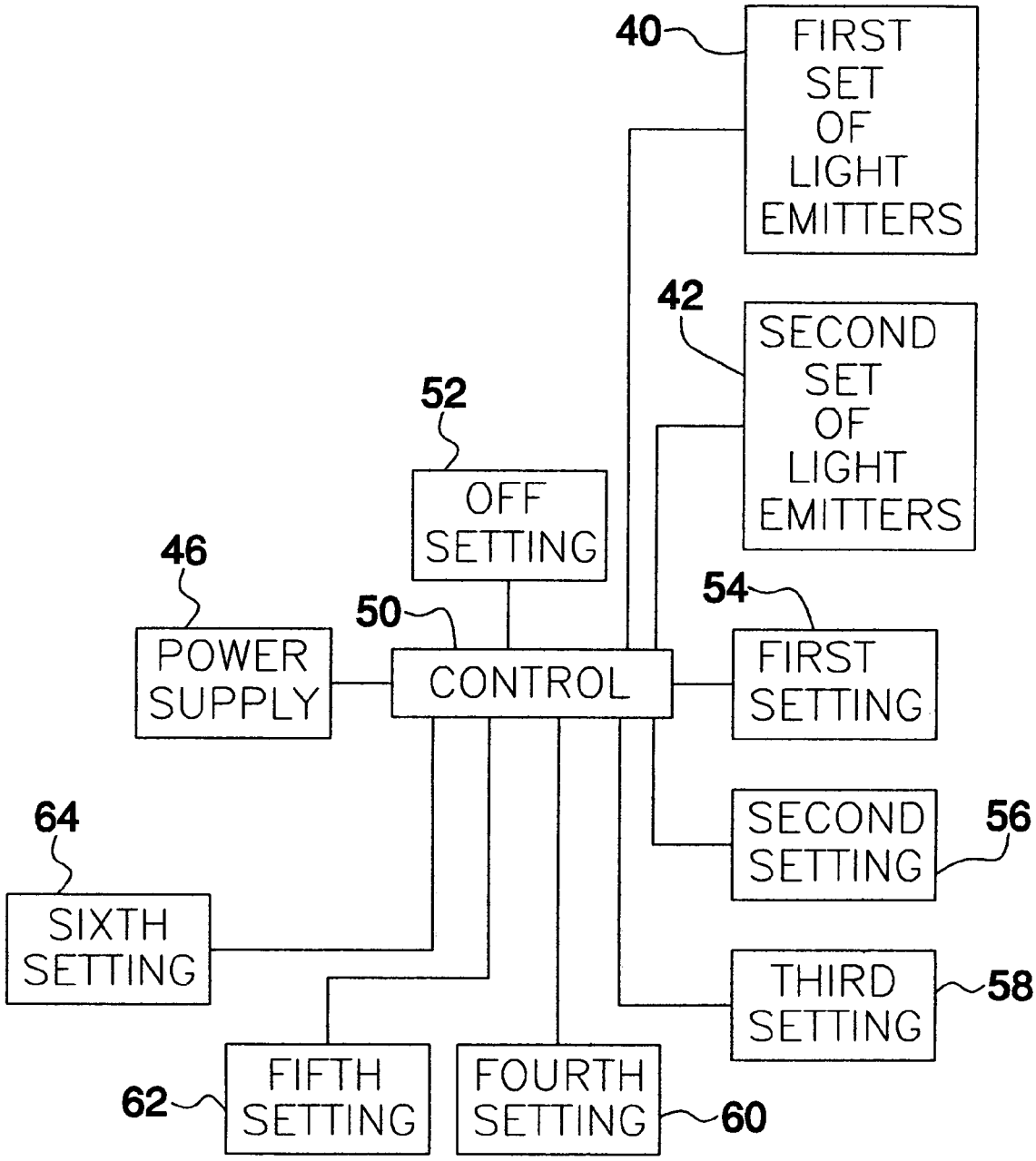
FIG. 5 is a schematic view of the present invention.

With reference now to the drawings, and in particular to FIGS. 1 through 4 thereof, a new emergency light device embodying the principles and concepts of the present invention and generally designated by the reference numeral 10 will be described.

As best illustrated in FIGS. 1 through 4, the emergency light assembly 10 generally comprises a flexible panel 12 that has a front side 14, a back side 16, a top edge 18, a bottom edge 20, a first lateral edge 22, and a second lateral edge 24. The panel 12 has a plurality of apertures 26 extending therethrough. Each of the apertures 26 has a diameter less than ½ inch. The apertures 26 allow air to flow through the panel 12 so that it remains relatively stable in the wind. A pocket 28 is attached to the back side 16 and extends along the bottom edge 20. The panel 12 has a height from the top edge 18 to the bottom edge 20 generally between 2.5 feet and 3.5 feet. The panel has width from the first lateral edge 22 to the second lateral edge 24 generally between 3.5 feet and 4.5 feet. The panel 12 has a plurality of openings 30 extending therethrough. Each of the openings 30 is positioned adjacent to top edge 18. The openings 30 each have a diameter greater than ½ inch. Reinforced ring members 32, or grommets, extend along peripheral edges of the openings 30. A weight 34 is positioned in the pocket 28. The weight 34 also serves to stabilize the panel.

A first set of light emitters 40 is mounted in the panel 12 and is configured to emit light outwardly from the front side 14. The first set of light emitters 40 is arranged in an arrow shape directed toward the first lateral edge 22. A second set of light emitters 42 is mounted in the panel 12 and is configured to emit light outwardly from the front side 14. The second set of light emitters 42 is arranged in an arrow shape directed toward the second lateral edge 24. The first set of light emitters 40 is positioned adjacent to the first lateral edge 22 and the second set of light emitters 42 is positioned adjacent to the second lateral edge 24. A covering 44 may be positioned over the back of the first 40 and second 42 light emitters to air in retaining them in position and to protect their wire leads from being damaged.

A power supply 46 is electrically coupled to each of the first 40 and second 42 set of light emitters. The power supply 46 preferably includes a plurality of batteries which may be rechargeable batteries. An auxiliary power supply may be used and include a male vehicle power plug 48.

A control 50 is operationally coupled to the first and second light emitters for selectively turning the first 40 and second 42 light emitters on or off. The control 50 has an off setting 52 turning each of the first 40 and second 42 sets of light emitters off, a first setting 54 turning the first set of light emitters 40 on, a second setting 56 turning the second set of light emitters 42 on, a third setting 58 turning the first set of light emitters 40 off and on in a repeated manner and a fourth setting 60 turning the second set of light emitters 42 off and on in a repeated manner. The control 50 may also include a fifth setting 62 simultaneously turning on each of the first 40 and second 42 sets of light emitters in a repeated manner and a sixth setting 64 wherein light emitters from the first 40 and second 42 light emitters turn off an on in such a manner that they appear to be moving along the first and second sets of lights.

In use, the panel 12 is placed on a vehicle during an emergency situation or during a breakdown of the vehicle to signal to oncoming traffic that they need to avoid the vehicle. The user then selects the proper setting on the control 50 depending on which direction the user feels the traffic should move to avoid the vehicle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A warning light apparatus for warning oncoming traffic of an upcoming hazard, said apparatus comprising:

a flexible panel having a front side, a back side, a top edge, a bottom edge, a first lateral edge, and a second lateral edge;

a first set of light emitters being mounted in said panel and being configured to emit light outwardly from said front side, said first set of light emitters being arranged in an arrow shape directed toward said first lateral edge;

a second set of light emitters being mounted in said panel and being configured to emit light outwardly from said front side, said second set of light emitters being arranged in an arrow shape directed toward said second lateral edge;

a power supply being electrically coupled to each of said first and second set of light emitters;

a control being operationally coupled to said first and second light emitters for selectively turning said first and second light emitters on or off, said control having an off setting turning each of said first and second sets of light emitters off, said control having a first setting turning said first set of light emitters on, said control having a second setting turning said second set of light emitters on; and a pocket being attached to said back side and extending along said bottom edge, a weight being positioned in said pocket, said weight stabilizing said panel.

2. The apparatus according to claim 1, wherein said panel has a plurality of apertures extending therethrough, each of said apertures having a diameter less than ½ inch, said apertures being randomly positioned on said panel.

3. The apparatus according to claim 1, wherein said panel has a height from said top edge to said bottom edge generally between 2.5 feet and 3.5 feet, said panel having width from said first lateral edge to said second lateral edge generally between 3.5 feet and 4.5 feet.

4. The apparatus according to claim 1, wherein said first set of light emitters is positioned adjacent to said first lateral edge and said second set of light is being positioned adjacent to said second lateral edge.

5. The apparatus according to claim 1, wherein said power supply comprises a plurality of batteries.

6. The apparatus according to claim 1, wherein said power supply includes a male plug removably positioned in a vehicle power socket.

7. The apparatus according to claim 1, wherein said control having a third setting turning said first set of light emitters off and on in a repeated manner, said control having a fourth setting turning said second set of light emitters off and on in a repeated manner.

8. The apparatus according to claim 7, wherein said control having a fifth setting simultaneously turning on each of said first and second sets of light emitters in a repeated manner.

9. A warning light apparatus for warning oncoming traffic of an upcoming hazard, said apparatus comprising:

a flexible panel having a front side, a back side, a top edge, a bottom edge, a first lateral edge, and a second lateral edge, said panel having a plurality of apertures extending therethrough, each of said apertures having a diameter less than ½ inch, a pocket being attached to said back side and extending along said bottom edge, said panel having a height from said top edge to said bottom edge generally between 2.5 feet and 3.5 feet said panel having width from said first lateral edge to said second lateral edge generally between 3.5 feet and 4.5 feet, said panel having a plurality of openings extending therethrough, each of said openings being positioned adjacent to top edge, each of said openings having a diameter greater than ½ inch, each of said openings including a reinforced ring member;

a weight being positioned in said pocket, said weight stabilizing said panel;

a first set of light emitters being mounted in said panel and being configured to emit light outwardly from said front side, said first set of light emitters being arranged in an arrow shape directed toward said first lateral edge;

a second set of light emitters being mounted in said panel and being configured to emit light outwardly from said front side, said second set of light emitters being arranged in an arrow shape directed toward said second lateral edge, said first set of light emitters being positioned adjacent to said first lateral edge and said second set of light emitters being positioned adjacent to said second lateral edge;

a power supply being electrically coupled to each of said first and second set of light emitters; and a control being operationally coupled to said first and second light emitters for selectively turning said first and second light emitters on or off, said control having an off setting turning each of said first and second sets of light emitters off, said control having a first setting turning said first set of light emitters on, said control having a second setting turning said second set of light emitters on, said control having a third setting turning said first set of light emitters off and on in a repeated manner, said control having a fourth setting turning said second set of light emitters off and on in a repeated manner, said control having a fifth setting simultaneously turning on each of said first and second sets of light emitters in a repeated manner.

* * * * *